United States Patent [19]

Kita

[11] 4,137,826

[45] Feb. 6, 1979

[54] PISTON PUMP

[75] Inventor: Yasuo Kita, Kyoto, Japan

[73] Assignee: Shimadzu Seisakushi, Ltd., Kyoto, Japan

[21] Appl. No.: 819,763

[22] Filed: Jul. 28, 1977

[51] Int. Cl.[2] ..... F01B 13/06

[52] U.S. Cl. ..... 91/497

[58] Field of Search ..... 91/472 G, 498

[56] References Cited

U.S. PATENT DOCUMENTS

| | | | |
|---|---|---|---|
| 2,245,570 | 6/1941 | Contervall | 91/472 |
| 2,716,945 | 9/1955 | Presnell | 91/485 |
| 3,094,077 | 6/1963 | Cadiou | 91/472 |
| 3,194,171 | 7/1965 | Ohligs | 91/472 |
| 3,810,418 | 5/1974 | Bosch | 91/484 |

FOREIGN PATENT DOCUMENTS

| | | | |
|---|---|---|---|
| 1923451 | 11/1970 | Fed. Rep. of Germany | 91/504 |
| 2028888 | 12/1971 | Fed. Rep. of Germany | 91/506 |

*Primary Examiner*—William L. Freeh

*Attorney, Agent, or Firm*—George B. Oujevolk

[57] ABSTRACT

This invention provides a piston pump in which a cylinder block is provided with a plurality of cylindrical apertures arranged radially with a tilt angle and a plurality of pistons are slidably inserted into each cylindrical aperture of the cylinder block and are held between the cylinder block and a cylindrical holder which is in contact with the outer end face of each piston. The cylinder block is rotatably fitted on the conical periphery of a slidable truncated conical pintle which is held eccentrically from the center of a driven shaft for rotating the cylinder block and the cylindrical holder together therewith. Thus, each piston can be reciprocated for pumping action by rotating the cylinder block together with the cylindrical holder around the conical periphery of the pintle so that each piston can suction up fluid through an arcuate groove formed on the conical periphery of the pintle and communicates with an inlet passage. Each piston discharges the pressure fluid to an outlet passage through another arcuate groove formed on the conical periphery of the pintle and passageway. With this construction it is possible to control the quantity of discharge fluid by adjusting the eccentric distance between the pintle and the driven shaft.

6 Claims, 9 Drawing Figures

PISTON PUMP

BACKGROUND OF THE INVENTION

The present invention relates to a piston pump, and more particularly to an advantageous piston pump which can be used in place of conventional axial plunger pump.

BRIEF DESCRIPTION OF THE PRIOR ART

Generally speaking, the piston or plunger type of fluid pump has an advantage in that it is capable of controlling the quantity of discharge fluid according to the discharge pressure in comparison with the gear pump, and has various uses, for example as seen in U.S. Pat. No. 2,990,781 and U.S. Pat. No. 3,236,189. However, almost all these types of pumps have been an axial plunger pump wherein the cylinder block (or cylindrical barrel) is provided with a plurality of elongated cylindrical apertures arranged satellitically in a circle around the driven shaft, extending in directions parallel to the driven shaft, and a plurality of extensible plunger assemblies consisting of a pair of slidable plug members are inserted into each of the cylindrical apertures and the pumping action is produced by the relative rotation between a group of plunger members and the inclined disk mounted on the driven shaft.

As each plunger member is arranged satellitically in the axial direction as in the conventional axial plunger pump there is the disadvantage that a larger diameter for each plunger member will require a change in the external shape of the pump housing and therefore a longer stroke in axial direction is required to obtain a larger quantity of discharge fluid, consequently the group of plunger members in rotating and being driven by the relative rotation between the cylinder block and the inclined disk will cause friction both at the top end and at the rear end touching the interior surface of each cylindrical aperture materially and cause wear, thereby resulting in producing a clearance between each cylindrical aperture and each plunger member which will deteriorate the efficiency of suction and discharge. In the reciprocating motion made by long stroked plunger members, resistance will prevent a high speed and high pressure operation more or less and therefore it is intrinsically unsuitable for the purpose. Besides, such a structure will inevitably produce a larger area of sliding surface in the contact between the inclined disk and each plunger member causing damage due to the constant friction of the inclined disk and each plunger member. These problems may be due to the structural and intrinsical disadvantage of the conventional axial plunger pump. Furthermore, in this type of pump it is difficult to keep the pressure balance of the cylinder block and the inclined disk.

OBJECTS OF THE INVENTION

Accordingly, it is a primary object of this invention to provide a piston pump with high efficiency having a simple structure, improving the construction due to the structural disadvantage of the axial plunger pump hereinbefore mentioned.

Another object of the invention is to provide a piston pump having a structure suitable to keep a good pressure balance in the pumping mechanism including the cylinder block, cylindrical holder and the circular truncated conical pintle.

A further object of the invention is to provide a piston pump equipped with an improved pressure compensating circuit of the discharge fluid.

A still further object of the invention is to provide a piston pump wherein the quantity of discharge fluid can be adjusted.

SUMMARY OF THE INVENTION

The piston pump relating to the invention has a slide block slidably supported on closing means in the enclosed chamber of the pump together with a casing and a pintle in the chamber, mounted on the slide block. The slide block has a trapezoidal cross-sectional shape. On the other hand the pintle is formed with a member which has a circular truncated conical form and is attached to the slide block at the bottom of the cone.

The conical periphery of the pintle has two oppositely situated arcuate grooves which communicate with an inlet passage and an outlet passage formed on the closing means.

Pressure balance of the pintle is so arranged that opposing the arcuate groove which communicates with the outlet passage there is formed a received pressure space having a definite area including the passageway communicating the outlet passage to the arcuate groove which is formed on the inclined surface of the slide block. The pressure space is filled with a high pressure discharge fluid.

Also on the pintle there is provided a cylinder block having plurality of cylindrical apertures in the conical periphery thereof in such a way that each cylindrical aperture is situated vertically with respect to the conical periphery of the truncated conical pintle. In each of the cylindrical apertures there is a piston, each piston is held between the cylinder block and a cylindrical holder having a plurality of flat faces in the interior wall thereof always in sealing contact with the outer end face of each piston. The cylinder block and cylindrical holder are driven to rotate integrally with each other by means of a common driven shaft.

At both end faces of the slide block there are disposed a couple of piston mechanisms opposite each other whose pressure forces are different, the pressure force of these piston mechanisms is given by a high pressure fluid of the discharge fluid, therefore, the slide block is forced to slide by being pushed by the piston mechanism having the larger pressure force against the pressure force of the other piston mechanism which has the smaller pressure force, resulting in becoming eccentric of the center of the pintle from the center of the driven shaft for rotating the cylinder block and cylindrical holder together therewith, the stroke of each piston being made in proportion to the eccentric distance.

The piston mechanism having a larger pressure force of the piston mechanisms pair or couple disposed opposite to each other at both end faces of the slide block and given a pressure force by means of the high pressure fluid of the discharge fluid, communicates with a drain passage through a relief valve, therefore, the piston mechanism having a larger pressure force, when the pressure of the discharge fluid has exceeded a predetermined amount is to be connected to the drain passage (kept at low pressure) by releasing of a relief valve, on the other hand, hand, the high pressure fluid of the discharge fluid is continuously introduced to the piston mechanism having the smaller pressure force. Consequently, the slide block is made to slide at once by means of the piston mechanism having the smaller pressure force to its original position, where the center of the pintle coincides with the center of the driven shaft, from the eccentric position to which it has been made to slide. That is to say, this is a pressure compensation mechanism.

Besides, in this piston pump mechanism, it is possible that the sliding distance of the slide block can be made to slide by means of the piston mechanism having a larger pressure force, that is to say, the eccentric distance of the pintle can be adjusted by such a mechanism so that the piston mechanism having smaller pressure force can have its pressure force adjusted by manual means or the pressure of another fluid.

Explaining the mechanism of the piston pump relating to this invention in a few words, a group of pistons held by a cylinder block and a cylindrical holder rotate around the conical periphery of an eccentric pintle, thereby each cylindrical aperture is connected to arcuate groves formed on the conical periphery of the pintle alternately, and forces each piston to reciprocate upwards and downwards in the cylindrical apertures to perform a pumping action.

Therefore, the piston pump relating to this invention has the advantage that the diameter of each piston and each cylindrical aperture of the cylinder block can be made larger without enlarging the external shape of the pump housing and also the overall length of stroke can be made shorter, virtually raising larger quantity of discharge fluid, thus, collaterally the friction between each piston and the interior surface of its cylindrical aperture can be reduced and consequently wearing is reduced. As a result, deterioration of the efficiency of the pumping action can be aboided, the pump can be operated with high efficiency.

Further, the piston pump of this invention is so constructed that it has no mechanical energy loss due to larger area of sliding surface as seen in the sliding surface of the piston and inclined disk of conventional axial plunger pump.

Further, the piston pump of this invention has the advantage of being capable of keeping a good pressure balance of the pintle with a simple mechanism, which secures smooth, high speed operation as well as mechanical durability of the piston pump.

Furthermore, the piston pump of this invention is equipped with an improved pressure compensation mechanism or circuit, wherein an effective pressure compensation is obtained at pressure compensating time in such a way that the high pressure fluid of the discharge fluid is circulated without being enclosed in the pumping chamber and the temperature of fluid does not rise.

Furthermore, with the piston pump of this invention it is possible to easily control the quantity of discharge fluid.

These and other objects, features and advantages of the invention will become apparent from the following description of the preferred embodiments of the invention with reference to the accompanying drawings in which:

DESCRIPTION OF THE PREFERRED EMBODIMENT

Figure 1:
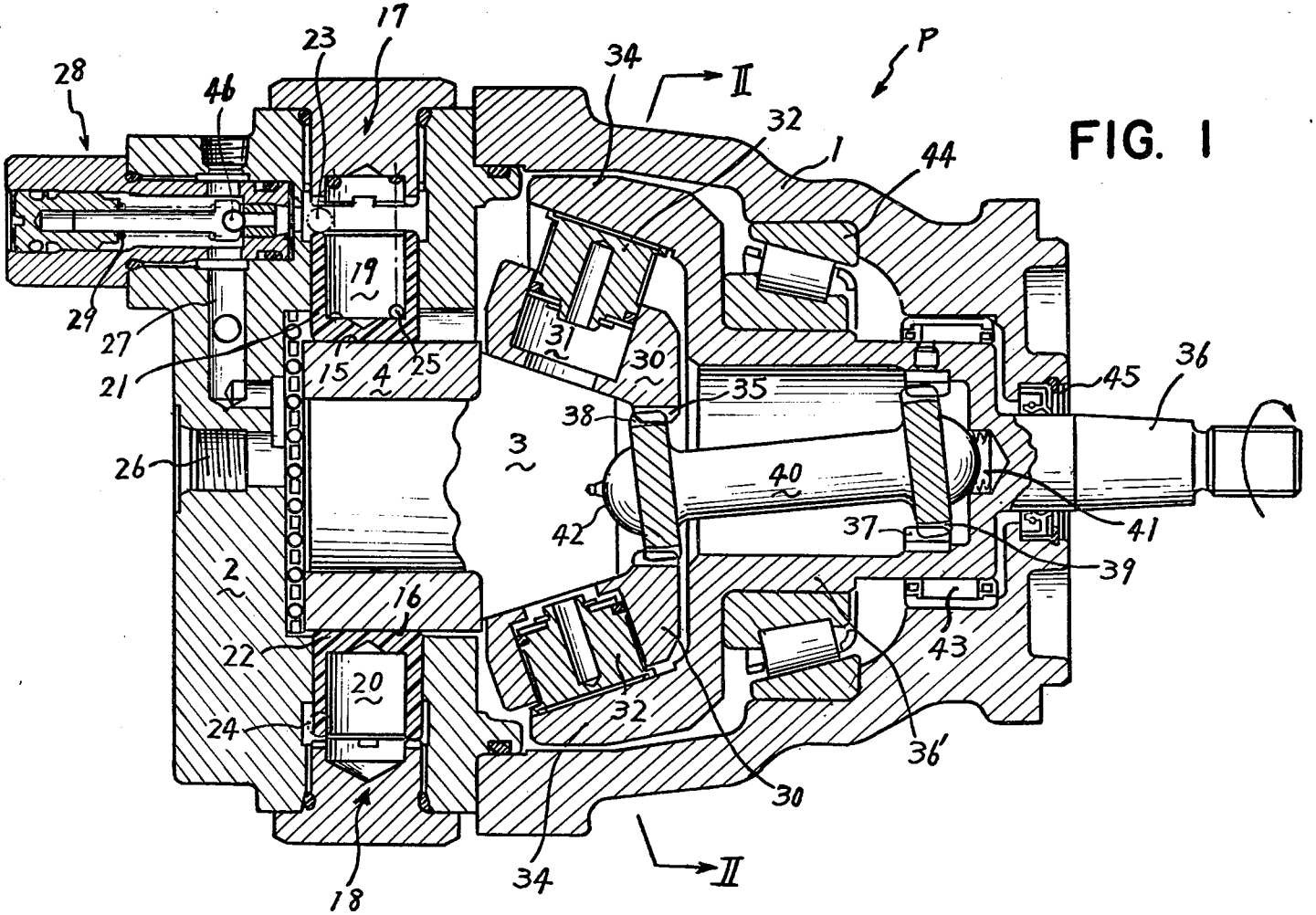
FIG. 1 is a longitudinal sectional view taken on line I — I in FIG. 3, of a piston pump showing an embodiment of the invention.
Figure 5:
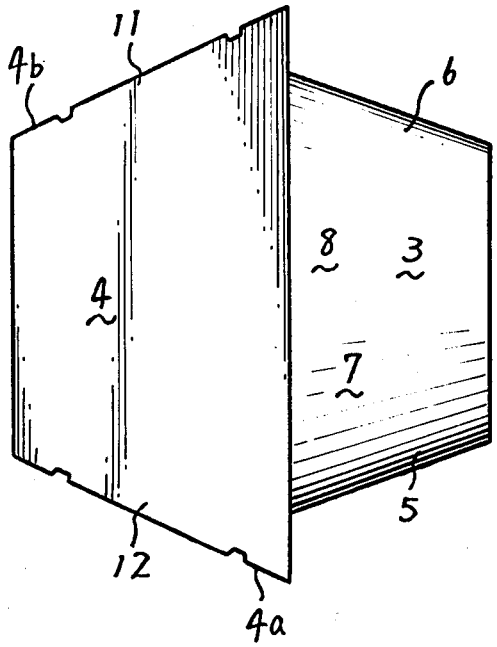
FIG. 5 is a plan view showing the pintle and slide block of the piston pump illustrated in FIG. 1.
Figure 6:
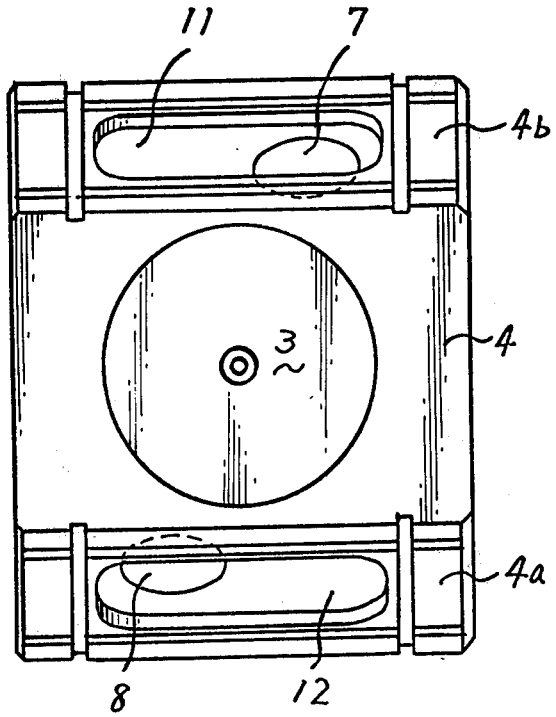
FIG. 6 is a left side elevational view thereof.
Figure 7:
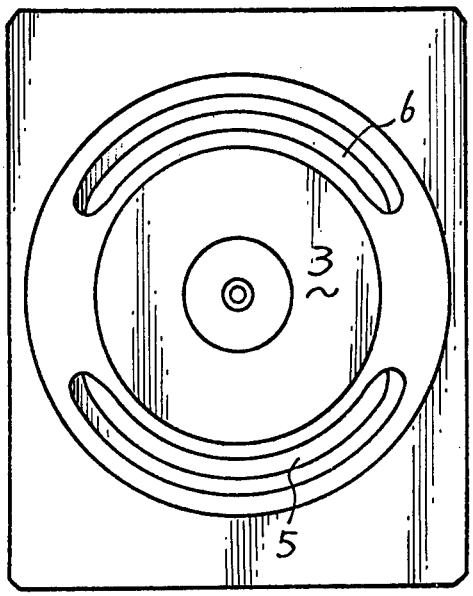
FIG. 7 is a right side elevation view thereof.
Figure 8:
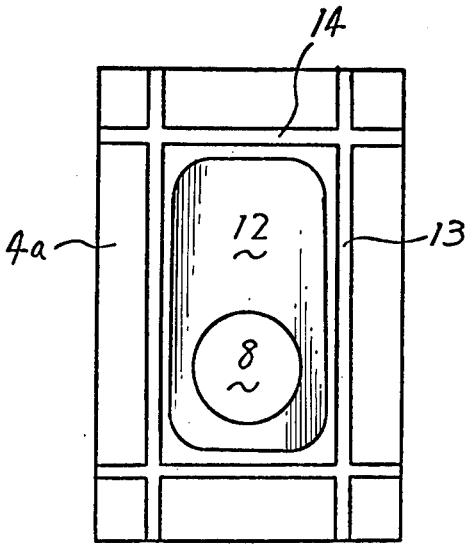
FIG. 8 is an elevational view showing the inclined surface of the slide block illustrated in FIG. 5; and, FIG. 9 is a graphic explanation of discharge pressure.

As illustrated in FIG. 1, in the piston pump of this invention, the pistons are not arranged in the axial direction, they are arranged radially with a tilt angle. In the drawings, the casing 1 constitutes the enclosed chamber of the pump P together with the closing means 2. The pintle 3 is held by the slide block 4 supported by said enclosure 2 and is protruding into said enclosed chamber of said pump P. As illustrated in FIGS. 5 and 7, said pintle 3 is formed by a member which is of circular truncated conical form, and said slide block 4 is formed by a member whose section is of trapezoidal form, which is slidably supported by said closing means 2 wherein both the inclined surfaces 4*a* and 4*b* thereof are used as the guiding surface.

There are formed two arcuate grooves 5 and 6, which are located opposite to each other, on the conical periphery of said pintle 3 over the angular range of approximately 130 degrees. These arcuate grooves 5 and 6 communicate with the inlet passage 9 and outlet passage 10 formed at said enclosure 2 through the passageways 7 and 8 opened in slide block 4. On inclined surfaces 4*a* and 4*b* which are the guiding surface for sliding the slide block 4 and located opposite arcuate groove 6 formed on the conical periphery of pintle 3, there are defined pressure spaces 11 and 12 having a predetermined surface area. Pressure spaces 11 and 12 include the opening aperture of passageways 7 and 8 communicating the arcuate grooves 5 and 6 to inlet passage 9 and outlet passage 10. These receiving spaces 11 and 12 are necessary for the inclined surface 4*a*. The definite area of said pressure spaces 11 and 12 are equal to the projected area of some pistons which communicate with arcuate groove 6, that is, the discharge side among the pistons hereinafter mentioned and the size is determined by taking into consideration the range of area required for properly communicating passageways 7 and 8 to inlet passage 9 and outlet passage 10 so as to allow for overlapping during the sliding of said slide block 4. With regard to said space 11 opposite arcuate groove 5 which communicates with said inlet passage 9, it is enough if the condition hereinbefore mentioned is satisfied. The balancing grooves 13 and 14 are formed around received pressure spaces 11 and 12, which grooves 13 and 14 are provided to seal any fluid leaked through said spaces 11 and 12 and to lubricate said slide block 4 for sliding on said inclined surfaces 4*a* and 4*b*.

The slide block 4 slides in such a way that there is to be a very slight eccentricity between the center of pintle 3 and the center of a driven shaft when it is ready to slide before sliding, that is, the sliding is almost zero, and on the other hand, there is to be the greatest eccentricity between the center of pintle 3 and the center of the driven shaft when it has slid to the maximum. The eccentric distance "l" of both corresponds to the stroke of the piston mentioned hereinafter, and is proportioned to the quantity of discharge fluid, therefore, it is possible to control the quantity of discharge fluid by adjusting the eccentric distance "l".

The sliding of slide block 4 is constructed as follows:

A pair or couple of piston mechanisms 17 and 18 are disposed opposite each other at both end faces 15 and 16 of slide block 4. The piston mechanisms 17 and 18 consist of the same diameter of cylindrical apertures 19 and 20 formed on enclosure 2 and the same diameter of pistons (or spools) 21 and 22 inserted therein. A discharge fluid is to be introduced into cylindrical apertures 19 and 20 of piston mechanisms 17 and 18 through the passageways 23 and 24 from outlet passage 10. Therefore, as a compression spring 25 is inserted between piston 21 and the interior, one end face of cylindrical aperture 19 of piston mechanism 17, although the pressure force due to a disharge fluid from piston 21 is equal to the pressure force due to the discharge fluid from piston 22, there arises a difference of the pressure force between the pressure force from both piston mechanisms 17 and 18 and the pressure force of compression spring 25 inserted in piston mechanism 17. Thus, piston mechanism 17 containing the compression spring 25 therein makes the slide block 4 slide.

There arises the greatest eccentric distance between pintle 3 and driven shaft when slide block 4 has slid the greatest distance by reason of the fact that piston mechanism 17 has the larger pressing force. As for piston mechanism 17 having a larger pressing force, the inside of its cylindrical aperture 19 communicates with drain passage 26 through the relief valve 28 and passageway 27 in that order. The predesigned pressure of relief valve 28, that is, the pressing force of spring 29 corresponds to the maximum pressure of the discharge fluid, for an example, 210kg/cm$^2$. Therefore, when the pressure of the discharge fluid has passed over the predesigned discharge pressure, relief valve 28 is released, and the inside of cylindrical aperture 19 of piston mechanism 17, which has the larger pressure force, is connected to drain passage 26. On the other hand, as the high pressure fluid of the discharge fluid is still being introduced into piston mechanism 18, the smaller pressure force, said piston mechanism 18 will make slide block 4 slide to its original position where there is left a very slight eccentric distance between pintle 3 and the driven shaft. A passageway formed of drain passage 26, passageway 27, and piston mechanism 17 communicate with the inside of cylindrical aperture 19 due to releasing of relief valve 28 consequently form the "open circuit" to a tank (not shown in the drawings) through drain passage 26 or the "closed circuit" to inlet passage 9 through drain passage 26 because the inside of cylindrical aperture 19 is connected to outlet passage 10 through passageway 23.

Figure 2:
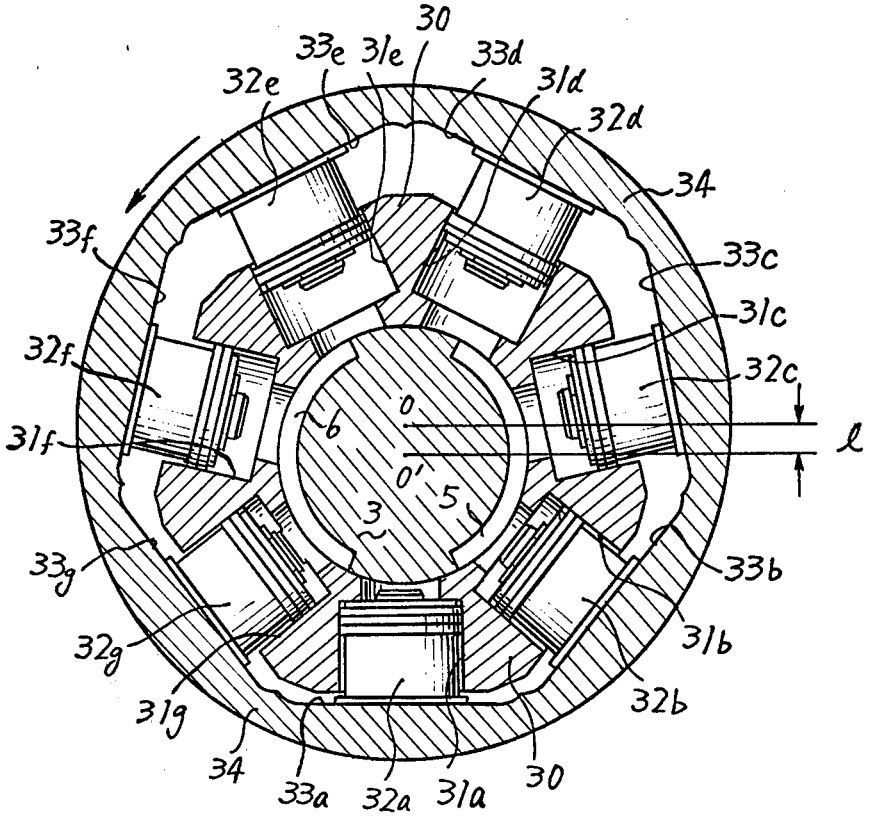
FIG. 2 is a sectional view taken on line II — II in FIG. 1.
Figure 3:
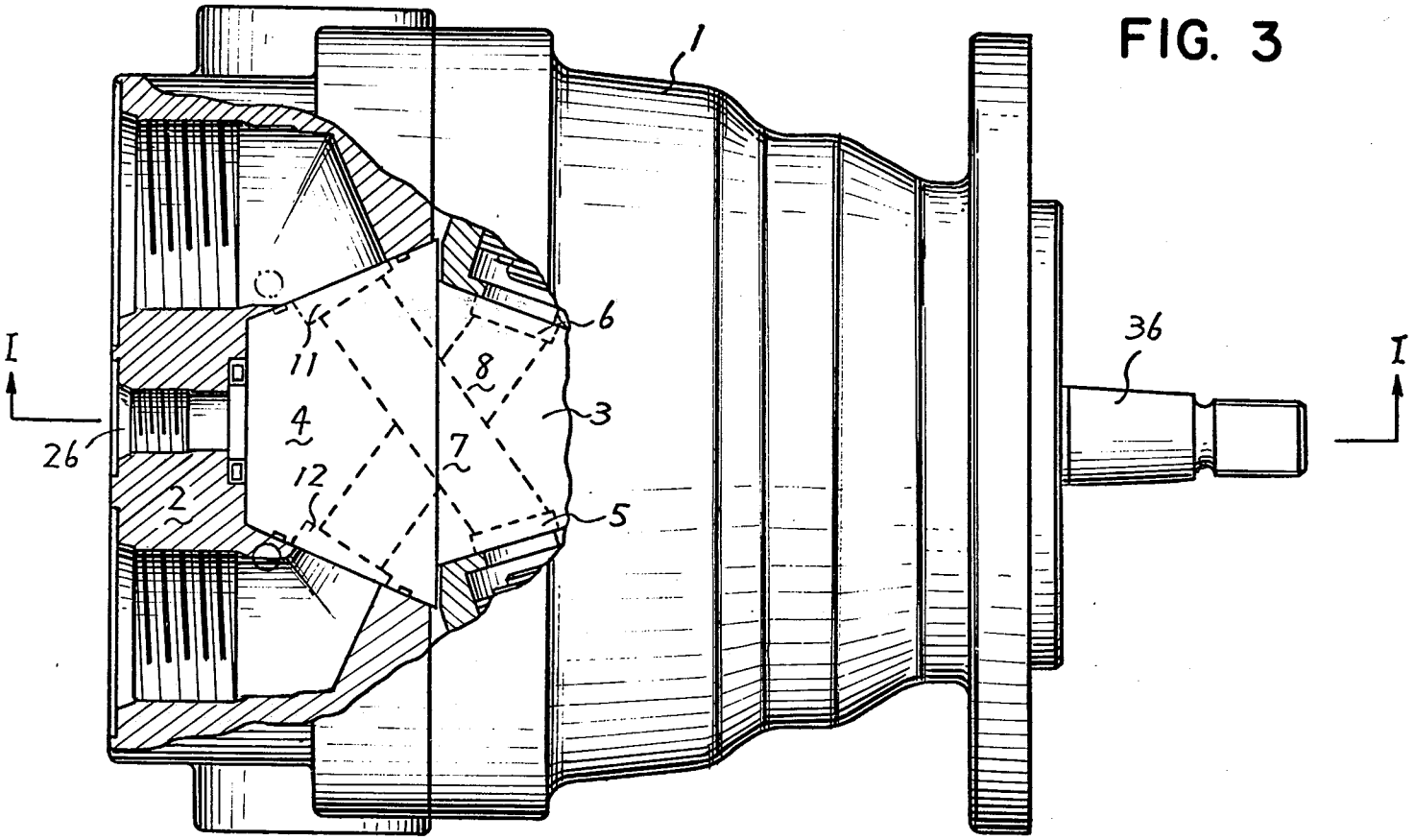
FIG. 3 is a plan view, partly broken to show a pintle and a slide block, of the piston pump illustrated in FIG. 1.
Figure 4:
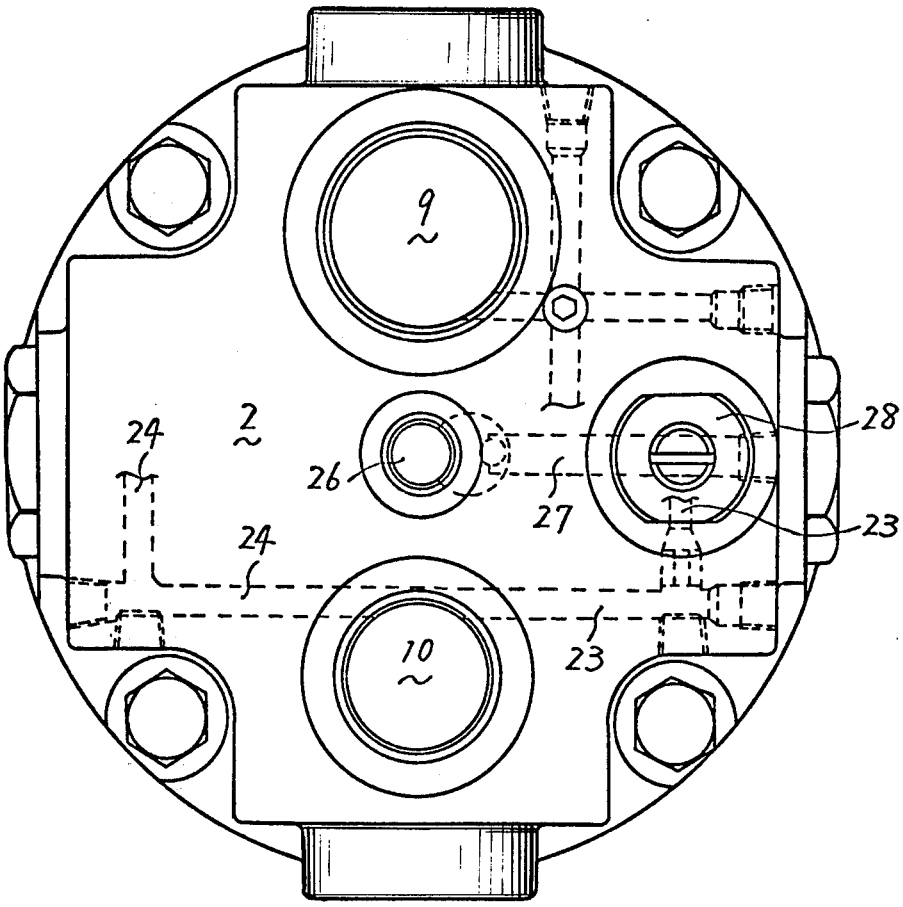
FIG. 4 is a left side elevation view of the pump shown in FIG. 1 and FIG. 3.

The cylinder block 30 has its conical inner surface aligned with the conical periphery of pintle 3. On cylinder block 30 there are formed a plurality of cylindrical apertures **31*a*–31*g* in such a way to be radially vertical to the conical periphery of pintle 3. Each cylindrical aperture 31*a*–31*g* of cylinder block 30 is slidably engaged with the piston 32*a*–32*g*, respectively. As shown in FIG. 2 each piston 32*a*–32*g* is held by means of cylinder block 30. And, an outer cylindrical holder 34 having a plurality of flat faces 33*a*–33*g* in the interior wall thereof is in contact with the outer end face of each piston 32*a*–32*g*, in such a way as to hold the pistons between the interior wall and the cylinder block 30. Each piston 32*a*–32*g* is always in contact with each flat face 33*a*–33*g* of said cylindrical holder 34. In order to keep them so, a compression spring (not shown in the drawing) is preferably inserted in each cylindrical aperture 31*a*–31*g*, however, each piston 32*a*–32*g* can also be held by being suctioned by said holder 34 due to the "absorption action" without providing the compression spring therein if the outer end face of each piston 32*a*–32*g* is kept in tight sealing contact with the flat face 33*a*–32*g* of the holder 34**.

In the preferred embodiments of this invention, the diameters of each cylindrical aperture **31*a*–31*g* and each piston 32*a*–32*g*** are comparatively large, and, on the contrary, the overall length of the stroke is comparatively short, of course, the practical and virtual discharge fluid capacity is larger than that of conventional axial plunger pumps.

The cylinder block 30 and cylindrical holder 34 together with each piston **32*a*–32*g* rotate around the conical periphery of pintle 3** integrally in the following way:

The cylinder block 30 is to be made to rotate by means of the rotation of a transmission shaft 40 having the splines 38 and 39 engage with a spline 35 formed on the inner surface of a bore formed in the center and a spline 37 formed on the inner surface of the rotating member cup 36' integral with the driven shaft 36. The transmission shaft 40 is rotatably supported by means of spherical bearing 42 provided on the protruding end face of pintle 3, and are urged by a compression spring 41 provided between said driven shaft 36 and transmission shaft 40. The rotating member cup 36' is supported rotatably by means of the bearing 43 within said casing 1. The cylindrical holder 34 is formed as cup lips of said rotating member 36' and is rotatably supported by means of the angular contact bearing 44 within casing 1 and they are thus to be rotated together with said driven shaft 36. The driven shaft 36 is sealed against the outside of the casing 1 by sealing means 45. The cylinder block 30 rotates along the conical periphery of pintle 3, and on the other hand, holder 34 rotates around the driven shaft, consequently the rotational path of cylinder block 30 as it rotates around said pintle 3 is eccentric when the position of pintle 3 is eccentric with regard to the center of driven shaft 36, resulting in the cylinder block 30 becoming eccentric from the center of said holder 34 and driven shaft 36. Thereby, each piston **32*a*–32*g* of cylinder block 30** is to be made reciprocate because of the eccentric position, that is, they are to perform a pumping action.

OPERATION OF THE INVENTION

When slide block 4 is made to slide by means of said piston mechanism 17 having the larger pressure force, the center of pintle 3 is eccentric from the center of driven shaft 36 as shown in FIG. 1, the driven shaft 36 being made rotatable by means of a power drive (not shown) is to rotate cylinder block 30 together with holder 34. In FIG. 2, therefore, each piston **32*a*–32*g* reciprocates for a pumping action, thereby each piston 32*b*, 32*c* and 32*d* is to suction fluid gradually through arcuate groove 5 formed on the conical periphery of pintle 3, inlet passage 9, and passageway 7 in that order. Then each piston 32*e*, 32*f* and 32*g* is to discharge the pressure fluid (discharge fluid) gradually to outlet passage 10 through arcuate groove 6 formed on the conical periphery of pintle 3, and passageway 8 in that order. Thus, three or four pistons among said pistons 32*a*–32*g*** are to suction the fluid in consecutive order through arcuate groove 5 and other pistons among them pistons 32*a*–32*g* are to discharge the pressure fluid in consecutive order through said arcuate groove 6, and repeat the pumping action. Part of the quantity of discharge fluid through discharge groove 6 is to be introduced into said cylindrical apertures 19 and 20 of the pair or couple of piston mechanisms 17 and 18 opposite each other at both the end faces of slide block 4 through said passageways 23 and 24, in this case, however the high pressure fluid due to the discharge fluid introduced therein does not affect the pressure force because the diameters of both cylindrical apertures are the same.

The high pressure on pintle 3 by means of the three or four pistons which communicate with arcuate groove 6 among said pistons 32*a*–32*g* is received by pressure space 12 provided on the inclined surface 4*a* of slide block 4, thereby pintle 3 and said slide block 4 are kept in good balance. The function of pressure space 12 is attained by introducing high pressure fluid of the discharge fluid into space 12 having a predetermined area.

Figure 9:
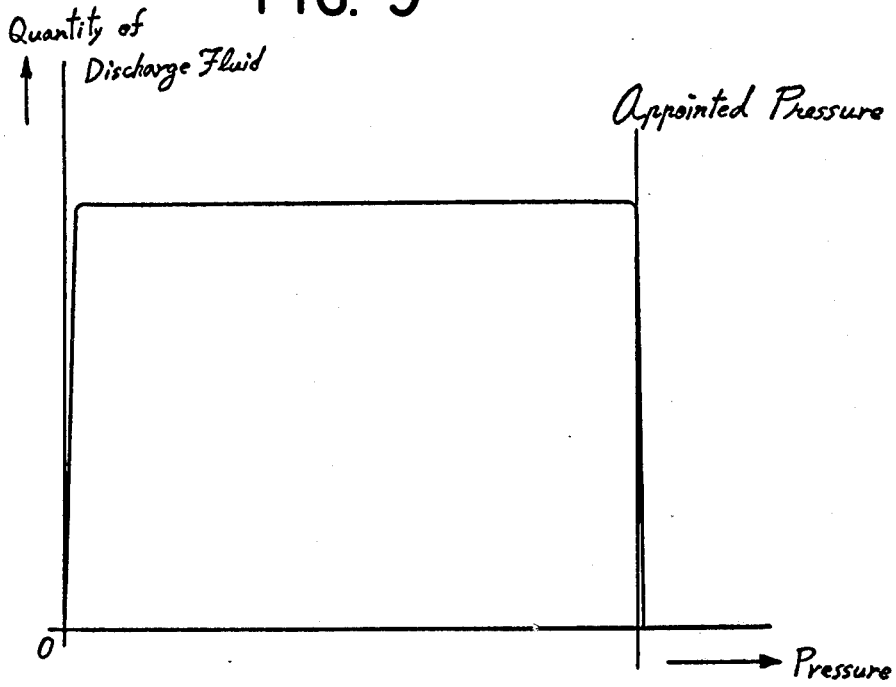

If the discharge pressure rises abnormally, that is, if any abnormal conditions are brought about in the continuous discharging condition, it is necessary to stop the discharging at once because it is dangerous to continue the discharging of the fluid. However, it is very inefficient to stop the pump by the operator each time any abnormal conditions occur. Therefore, these types of pumps are usually equipped with a pressure compensation circuit, the embodiments of this invention also have such a circuit. The mechanism of the pressure compensation circuit applied to the piston pump is as follows:

A discharge fluid is introduced into a pair or couple of piston mechanisms 17 and 18 opposite each other at both end faces 15 and 16 of cylinder block 4. Any abnormal pressure rise of discharging will naturally raise the pressure of the fluid introduced into said pair or couple of piston mechanisms 17 and 18, and relief valve 28 which communicates with piston mechanism 17 having the larger pressure force will be released in such a way that the ball 46 is pushed down against the pressure force of spring 29, thus, piston mechanism 17 will be connected to a drain passage 26. As a result, the pressure on slide block 4 to make it keep sliding will be reduced abruptly, however, the high pressure fluid is still being introduced into piston mechanism 18. Thus, the relation between both piston mechanisms will be reversed. Thereby, slide block 4 will be returned to its original position by means of piston mechanism 18, in other words, pintle 3 will be returned to the position where there is a very slight eccentric distance left between pintle 3 and driven shaft 36, so that the stroke of each piston 32*a*–32*g* of said cylinder block 30 will be nearly zero. Thus, the pumping action, that is, suction and discharging of the fluid will be greatly reduced resulting in decreasing of the discharging of fluid abruptly, which condition is shown in FIG. 9. In this case, however, the stroke of each piston 32*a*–32*g* is usually obtained to some degree because complete stopping of discharging action will cause the contacting faces or sliding faces between cylinder block 30 and pintle 3 or contact between each cylindrical aperture 31*a*–31*g* and each piston 32*a*–32*g* to be stopped, resulting in producing unfavorable conditions such as abrupt rising of the temperature of the fluid and so forth. Although a situation like this may have been taken also in the conventional axial plunger pumps, there has not been provided so far such a passageway to relieve some quantity of discharge fluid therethrough by natrually produced flow as the result of securing a part of the stroke of each piston in the structure of conventional pumps. As a result, it is not possible to prevent the unfavorable condition such as a rise in the temperature of fluid. In the structure of the embodiments of this invention, however, there is provided the safety passageway which is not provided in the structure of the pumps. That is to say, piston mechanism 17 having the larger pressure force communicates with drain passage 26 trhough relief valve 28 and passageway 27 in that order, and the inside of said cylindrical aperture 19 of piston mechanism 17 communicates with outlet passage 10 through passageway 23. Ultimately, outlet passage 10 is connected to these members, e.g., passageway 23, the inside of cylindrical aperture 19 of piston mechanism 17, relief valve 28, passageway 27, and drain passage 26. And, drain passage 26 communicates with the tank or inlet passage 9. Thus, the open circuit or closed circuit is formed with these passages and therefore the fluid can be circulated efficiently without confining a quantity of discharge fluid in the pump.

The inventive concept also includes a situation where there is a difference between the pressure force of piston mechanism 17 and that of piston mechanism 18 opposite each other at both end faces of said slide block 4, the same effect can also be obtained by providing the pair of cylindrical apertures 19 and 20 and the pair of pistons 21 and 22 with a configuration wherein the diameter of those on one side is different from those on the other side. Also, it is possible to adjust the sliding distance of said block 4, that is, the eccentric distance of pintle 3 optionally by causing piston 22 of said piston mechanism 18 to have a smaller slide pressure force by manual or by means of the pressure of another fluid against the pressure force of piston mechanism 17 having the larger pressure force. Thus, the quantity of discharge fluid can be controlled optionally.

I claim:

1. A piston pump comprising:

a. a casing defining an enclosed chamber of the pump together with closing means (2);

b. a circular truncated pintle (3) with a conical periphery held by a slide block (4) slidably supported on said closing means (2) within said enclosed chamber, said slide block (4) having a trapezoidal cross-section with an inclined surface and end faces;

c. two arcuate grooves (5, 6) located opposite each other on said conical periphery of said pintle (3), said arcuate grooves (5, 6) communicating with an inlet passage (9) and an outlet passage (10) formed on said closing means (2) through passageway opened in said pintle (3) and said slide block (4);

d. a pressure space (12) provided on the inclined surface of said slide block (4) opposite said arcuate groove (6) communicating with said outlet passage (10), said pintle (3) and said slide block (4) are balanced by said pressure space (12);

e. a cylinder block (30) having a plurality of cylindrical apertures arranged radially and vertically with respect to the conical periphery of said pintle (3), said cylinder block (30) being rotatably disposed over the conical periphery of said pintle (3);

f. a a plurality of pistons (32*a*, 32*g*) with end faces, said pistons being disposed in each cylindrical aperture of said cylinder block (30);

g. a cylindrical cup (36') with cup lips holder (34) having a plurality of flat faces (33*a*, 33*g*) in the interior wall thereof in contact with said outer end faces of said pistons (32*a*, 32*g*), said pistons being kept between said cylindrical holder (34) and said cylinder block (30);

h. a driven shaft (36) coupled to said cup (36') for rotating said cylinder block (30) and said holder (34) together round the conical periphery of said pintle (3); and, i. means for sliding said slide block so that the axial center of said pintle (3) is eccentric from the axial center of said driven shaft (36).

2. A piston pump as defined in claim 1 in which said slide block (4) has a trapezoidal cross-section with an inclined surface and end faces, and a received pressure mechanism is provided on the inclined surface of said slide block (4) opposite said arcuate groove (6) communicating with said outlet passage (10), and said pintle (3) and said slide block (4) are balanced by said received pressure mechanism.

3. A piston pump as defined in claim 1, in which a passageway is provided so as to communicate said arcuate groove (6) to said outlet passage (10) in said slide block (4) and said pressure space (12) having a predetermined area including that of said passageway for receiving the pressure is so formed on the inclined surface of said slide block (4) as to keep the pressure balance of said pintle to correspond with the discharge fluid passing through said outlet passage (10).

4. A piston pump as defined in claim 1 wherein said means for sliding said slide block includes a couple of piston mechanisms one of which has larger pressure force than the other arranged opposite each other at both the end faces of said slide block, said piston mechanism having larger pressure force communicates with a drain passage through a relief valve, and said slide block (4) is made to slide by means of said piston mechanism having larger pressure force against the pressure force of said piston mechanism having a smaller pressure force so as to make said pintle position eccentric to said driven shaft (36), when the discharge pressure of fluid has been raised over a predetermined point, said relief valve being released, so that said piston mechanism having the larger pressure force is connected to said drain passage and said slide block (4) is returned to its original position by means of said piston mechanism having the smaller pressure force.

5. A piston pump as defined in claim 4, in which said piston mechanisms consist of a cylindrical aperture and a piston having the same diameter, and one piston mechanism has a compression spring therein in order to provide a difference between the pressure force of both piston mechanisms.

6. A piston pump as defined in claim 4, in which the piston mechanism having the smaller pressure force is added to its pressure force manually or with another pressure fluid to withstand the larger pressure force of said other piston mechanism in order to make an adjustment of eccentricity of said pintle due to the larger pressure force of said piston mechanism.

* * * * *

UNITED STATES PATENT AND TRADEMARK OFFICE

CERTIFICATE OF CORRECTION

PATENT NO. : 4,137,826

DATED : February 6, 1979

INVENTOR(S) : Yasuo Kita

It is certified that error appears in the above-identified patent and that said Letters Patent are hereby corrected as shown below:

On the cover sheet Item (73) Assignee should read:

-- Shimadzu Seisakusho, Ltd. --.

Signed and Sealed this

*Tenth* Day of *July 1979*

[SEAL]

*Attest:*

*Attesting Officer*

LUTRELLE F. PARKER

*Acting Commissioner of Patents and Trademarks*